US006874418B2

(12) United States Patent
Ullrich et al.

(10) Patent No.: US 6,874,418 B2
(45) Date of Patent: Apr. 5, 2005

(54) CUTTING DEVICE FOR CUTTING A PRINTING MATERIAL IN THE PRINTING UNIT OF A PRINTING DEVICE

(75) Inventors: Michael Ullrich, Poing (DE); Stefan Brecht, Munich (DE); Friedrich Meschenmoser, Grasbrunn (DE)

(73) Assignee: Oce Printing Systems GmbH, Poing (DE)

( * ) Notice: Subject to any disclaimer, the term of this patent is extended or adjusted under 35 U.S.C. 154(b) by 89 days.

(21) Appl. No.: 10/401,806

(22) Filed: Mar. 28, 2003

(65) Prior Publication Data

US 2003/0188647 A1 Oct. 9, 2003

(30) Foreign Application Priority Data

Apr. 8, 2002 (DE) ..... 102 15 351

(51) Int. Cl.[7] ..... B41F 13/60
(52) U.S. Cl. ..... 101/480; 101/226
(58) Field of Search ..... 101/226, 224, 101/480; 347/157; 242/554.2; 83/614, 56, 485, 487, 500, 821, 560

(56) References Cited

U.S. PATENT DOCUMENTS 794,060 A * 7/1905 Uzel ..... 29/564
2,427,611 A * 9/1947 Lane ..... 346/24
2,821,914 A * 2/1958 Schuba ..... 101/224
4,172,653 A 10/1979 Bujese
4,907,014 A * 3/1990 Tzeng et al. ..... 346/24
5,480,081 A * 1/1996 Wilson et al. ..... 225/96.5
6,246,856 B1 6/2001 Kopp et al.
6,260,457 B1 * 7/2001 Hakkaku ..... 83/167
6,813,985 B2 * 11/2004 Gharst et al. ..... 83/863

FOREIGN PATENT DOCUMENTS

DE 195 32 930 4/1997

* cited by examiner

*Primary Examiner*—Andrew H. Hirshfeld
*Assistant Examiner*—Leo T. Hinze
(74) *Attorney, Agent, or Firm*—Schiff Hardin LLP

(57) ABSTRACT

In electrographic printing devices which print a printing material, for example paper webs, there exists a problem in the case of a malfunction that the printing material has to be removed from the printing unit as this occurs it should be avoided that drive rollers for the printing material are dirtied by non-fixed toner images. To avoid this, a cutting device is provided that presents a reel cutter that is guided in a guide groove of a guide tube. When a malfunction occurs, the cutting device is activated, the reel cutter cuts the printing material, and the cut sections of the printing material are pulled out of the printing unit separately.

16 Claims, 4 Drawing Sheets

CUTTING DEVICE FOR CUTTING A PRINTING MATERIAL IN THE PRINTING UNIT OF A PRINTING DEVICE

BACKGROUND OF THE INVENTION

U.S. Pat. No. 6,246,856 B1 discloses a printing device, for example an electrophotographic printing device, with which a printing material such as a continuous paper web is printed. According to FIG. 1, which corresponds to FIG. 2 of U.S. Pat. No. 6,246,856 B1, a paper web AT is tensioned in a module M1, and is then provided with toner images of the characters to be printed in a printing unit in a transfer printing station T1 (module M2). In a module M3 (fixing station), the toner images are subsequently fixed. The transport path of the paper web AT through the printing device is as follows: the module M1 includes a loop drawing device SZ that functions as a web storage and buffers the paper web as well as holding the same under tension. Then the paper web AT is guided through the printing unit M2 over rollers WA1, WA2, the rollers WA2 defining the feed of the paper web. Finally, the paper web AT is guided through the fixing station M3 with the aid of further rollers WA3 and then exits the printer device. The exact functioning of the individual units of the modules M, such as character generator ZG, developer station E1, transfer printing station T1 and fixing station M3, in detail results from U.S. Pat. No. 6,246,856 B1, to which reference is made herewith.

In the case of a malfunction of the paper drive in the printing device, the paper web has to be removed therefrom, and in fact from the hardly accessible printing unit M2. There exists the problem that the already printed but not yet fixed paper web AT has to be pulled over the rollers, for example the rollers WA2 in FIG. 1, of the printing unit and dirties the same. As a consequence thereof, the rollers have to be cleaned. An object of the invention is to eliminate this problem.

SUMMARY OF THE INVENTION

According to the invention, a printing device or method is provided employing a cutting device for cutting a printing material in case of a malfunction where the paper material has to be removed. In one preferred embodiment, the cutting device is provided upstream of a printing station.

DESCRIPTION OF THE PREFERRED EMBODIMENT

Figure 1:
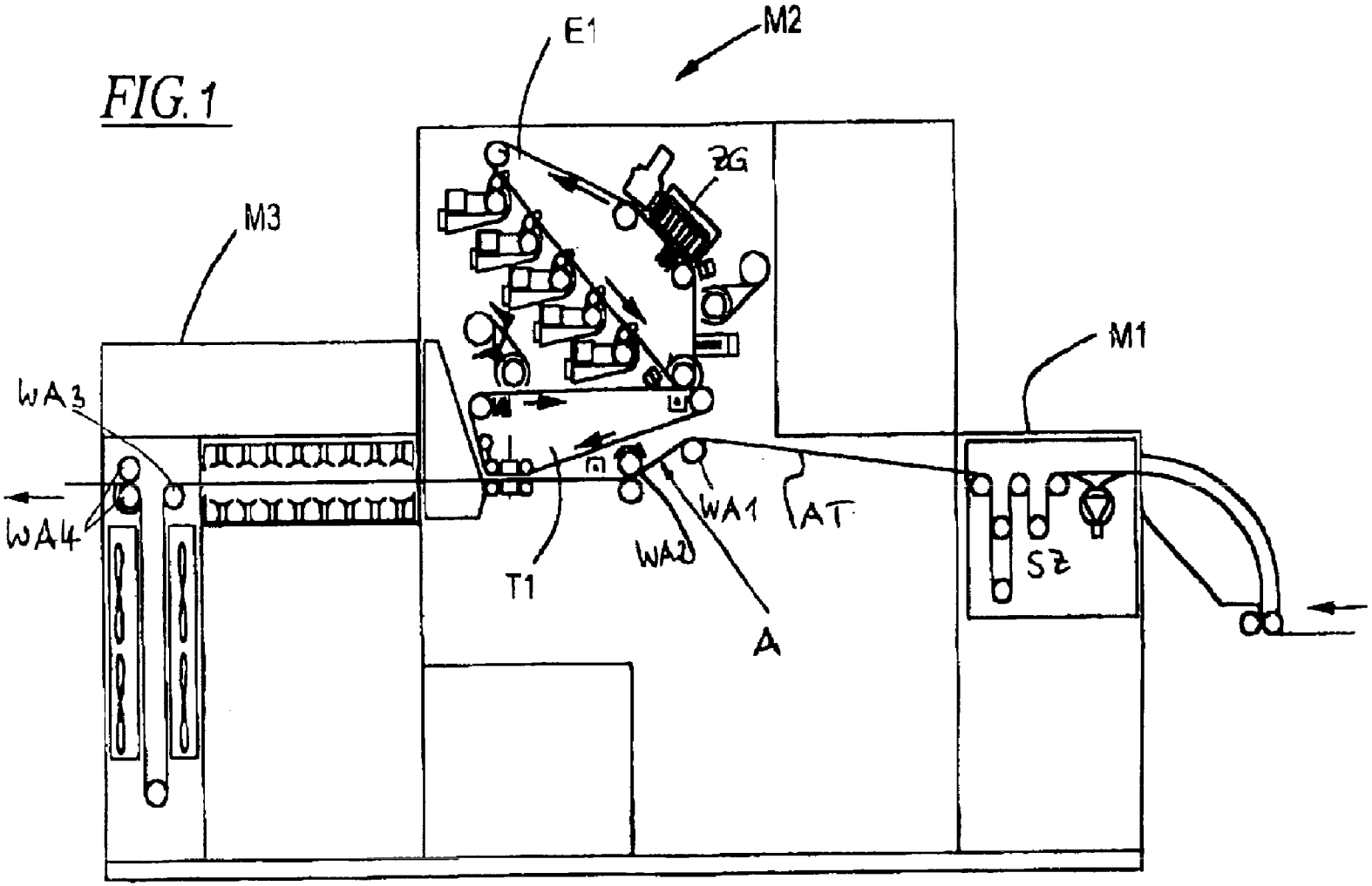
FIG. 1 shows a printing unit with shelves.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In the following explanation, a paper web is taken as an example of a printing material.

In the case of a malfunction of the paper drive in the printing device (module M2), the paper web can be cut by means of the cutting device integrated into the printing device. As a result thereof, the paper web can be removed from the hardly accessible printing unit to the input or output side. The advantage of this arrangement is that already printed but not yet fixed paper does not have to be pulled back over the rollers of the printing unit. As a result thereof, the dirtying of the rollers as well as the cleaning required thereby can be avoided.

Conveniently, the reel cutter can be secured to a slider, which in turn is arranged at the push rod.

When a pressure spring enclosing the push rod is arranged in the guide tube, the reel cutter can be brought back into its home position by the spring force of the pressure spring after the cutting operation.

It is advantageous when a Hall switch for determining whether the reel cutter is in the home position is mounted to the push rod. Then it can be identified whether the reel cutter is, during the printing operation, in a position in which it can undesirably damage the paper web.

In an electrographic printing device the cutter device can conveniently be arranged before the transfer printing station, or in ink printing devices before the ink printing unit, as viewed in the direction of the paper transport. Then, after cutting the paper web, the section not yet provided with toner images or ink can be pulled out of the printing unit.

The cutting device is very compactly designed so that it finds space in the printing unit with little structural space. The spatial conditions require free cutting, i.e. the paper is cut without support and clamping.

The expression "non-mechanical printing device" comprises at least electrophotographic, ionographic or magnetographic printing devices as well as ink printing devices.

Figure 2:
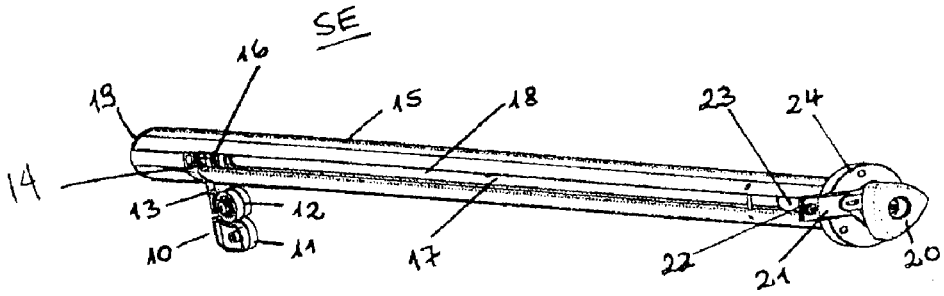
FIG. 2 shows an illustration of the cutting device.

The structure of the cutting device SE is show in FIG. 2. A reel cutter 10 (reel cutting principle) serves as a cutting tool. The two cutting reels 11, 12 are secured to the reel cutter reception 13 that is engaged into a transverse groove 14 in a guide tube 15 in the parking position (FIG. 2). The guide tube 15 further presents a guide groove 18. For guiding the reel cutter 10, a slider 16 positioned on a push rod 17 is used. The push rod 17 is slidably mounted in the guide tube 15. The guide groove 18 in the guide tube 15 allows a longitudinal movement of the push rod 17 and thus of the slider 16 with reel cutter 10 for cutting the paper web AT. At one end 19 of the guide tube 15, the guide groove 18 is continued in the transverse groove 14 such that a rotary motion of the reel cutter 10 for locking in the parking position is possible.

By means of a triangular handle 20 and the push rod 17 the reel cutter 10 can be rotated out of the parking position and can then be moved in the guide groove 18 linearly to the paper web AT for cutting the paper web.

A Hall switch 21 that is switched by a magnet 22 coupled to the push rod 17 serves for monitoring the parking position. By means of the Hall switch 21, it can be determined whether the reel cutter 10 is in the parking position. Should this not be the case during the printing operation, there is the risk that the reel cutter 10 damages the paper web AT in an undesired manner. Then countermeasures have to be taken.

By means of displacement of the push rod 17 during the cutting motion, a pressure spring 23 can be compressed, which is arranged in the guide tube 15, so as to enclose the push rod. After cutting the paper web, the spring force of the pressure spring 23 can then return the reel cutter back into its initial position. The inner volume of the guide tube 15 serves as a spring guidance.

The guide tube 15 can be fixed in the printing unit by means of a flange 24.

The cutting device SE is conveniently arranged at the location A in the printing unit M2 (FIG. 1), i.e. before the transfer printing station T1 as viewed in the transport direction of the paper web. Then, after cutting the paper web, the section carrying the unfixed toner images can be pulled out of the printing unit via the fixing station M3 and the section, which does not present any toner images yet via the module M1.

The cutting operation shall be explained with reference to FIGS. 3 to 6. The operational sequence is shown in principle. The paper web 10 is guided over rollers WA5 and is then fed to the transfer printing station (FIG. 1). The paper web is guided past the cutting device SE with the aid of the rollers WA5. The guide tube 15 is arranged parallel to the paper web AT and in fact adjacent to the paper web, without jeopardizing the transport of the paper web during normal operation.

Figure 3:
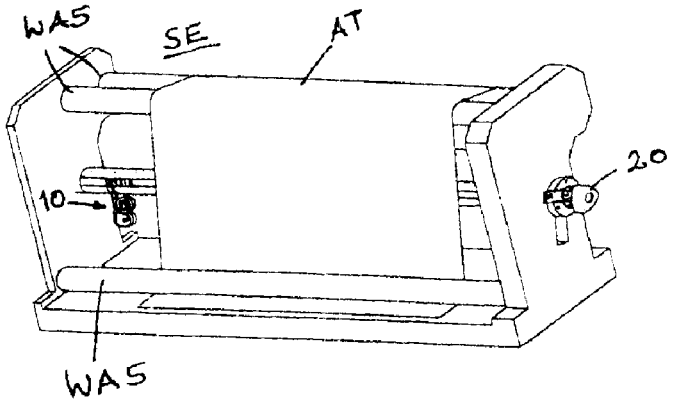
FIG. 3 shows the cutting device in an inoperative position (parking position)

FIG. 3 shows the parking position of the reel cutter 10. The paper web AT runs past the cutting device SE. The reel cutter 10 is hinged down in its parking (home) position.

Figure 4:
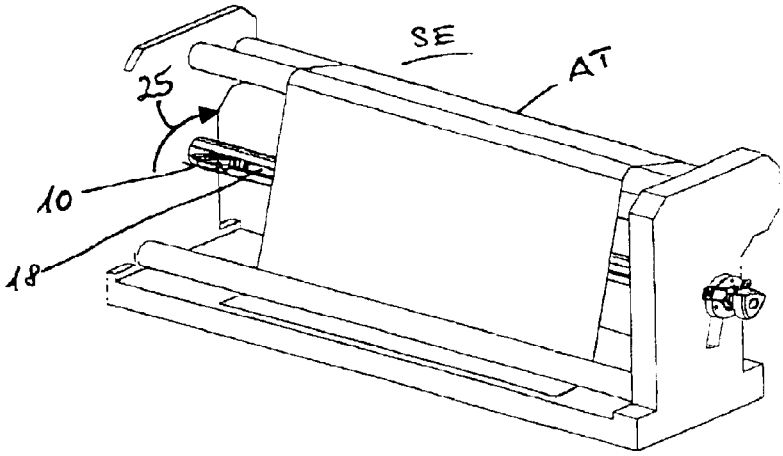
FIG. 4 shows the cutting device after unlocking at the start of the cutting operation.

FIG. 4 shows the position of the reel cutter 10, when for example, a malfunctioning has occurred and the paper web AT is to be cut (working position). The push rod 17 is rotated (arrow 25) and the reel cutter 10 is likewise rotated. The reel cutter is thus swiveled into the guide groove 18 of the guide tube 15 together with the slider 16.

Figure 5:
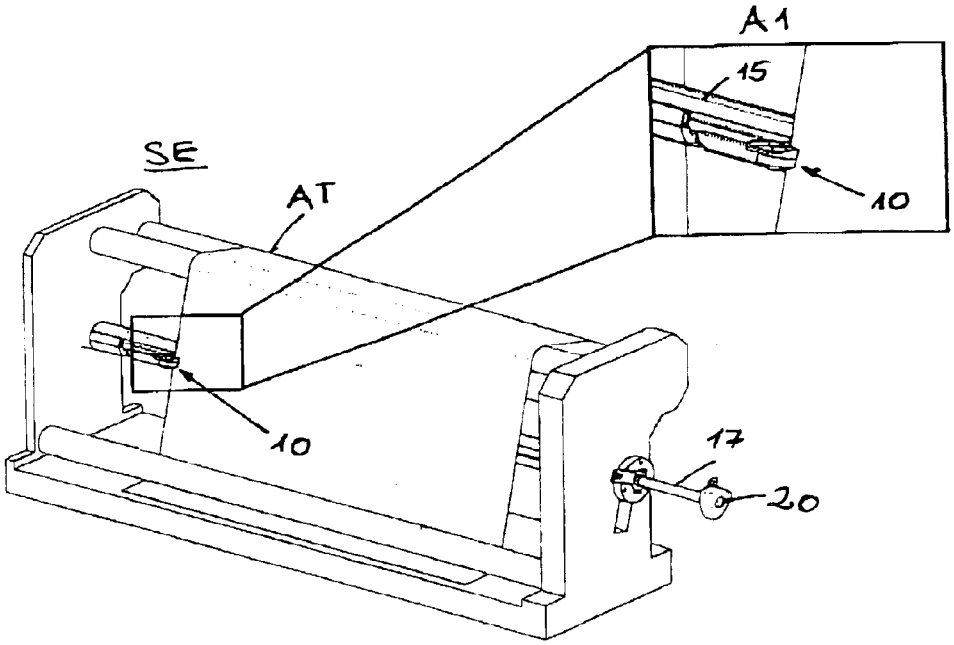
FIG. 5 shows the cutting device at the first cut of the paper.

FIG. 5 shows the position of the reel cutter 10 at the moment at which the cutting of the paper web AT begins. The reel cutter 10 encloses the paper AT with its two cutting reels 11, 12. This is more clearly shown in A1. There a detail of FIG. 5 is illustrated in enlarged scale. The push rod 17 is illustrated slightly extracted from the guide tube 15.

Figure 6:
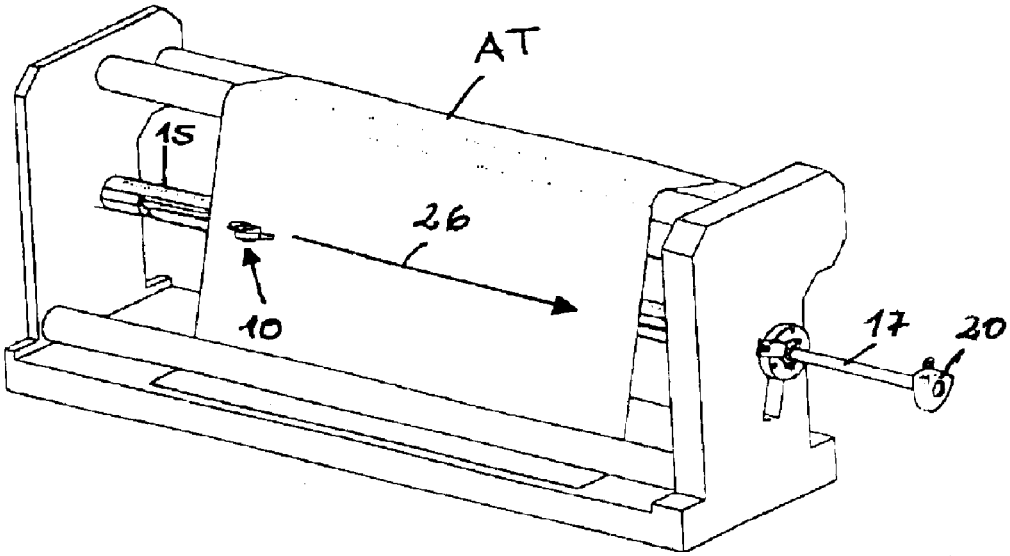
FIG. 6 shows the cutting device during the cutting operation.

FIG. 6 then shows the cutting operation. The reel cutter 10 grasps the paper web AT with its cutting reels 11, 12, moves along the paper web AT (arrow 26), and cuts the same into two sections. For this purpose, the push rod 17 is extracted and the pressure spring 23 is tensioned. After cutting the paper web, the cut sections can be pulled out of the printing unit M2 in opposite directions.

After complete cutting of the paper web, the push rod 17 and thus the reel cutter 10 is moved back into its initial position with the aid of the pressure spring 23. Afterwards, the reel cutter 10 is rotated back into the home position, which is the parking position.

The operation of the cutting device can take place manually by the operator; however, an automation of the cutting operation is likewise possible.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A printing device, comprising:

a printing unit which prints a web-shaped printing material;

a feeder which feeds the printing material to the printing unit;

a cutting device which cuts the printing material in order to remove the printing material from the printing device, the cutting device being arranged before the printing unit as viewed in a transport direction of the printing material;

said cutting device comprising a reel cutter arranged on a push rod, the push rod being slidably mounted to a guide tube arranged parallel and adjacent to the printing material, the guide tube having in a longitudinal direction a guide groove which ends at one end in a transverse groove such that the reel cutter is hinged down in a parking position, and for cutting the printing material, the reel cutter is moveable in a rotary motion to the guide groove and in the guide groove along the printing material, cutting reels of the reel cutter grasping the printing material.

2. The printing device according to claim 1 wherein the reel cutter is secured to a slider arranged on the push rod.

3. The printing device according to claim 1 wherein a pressure spring enclosing the push rod is arranged in the guide tube.

4. The printing device according to claim 1 wherein a Hall switch for determining whether the reel cutter is in the parking position is arranged on the push rod.

5. A printing device, comprising:

a printing unit for printing a web-shaped printing material;

a feeder for feeding the printing material to the printing unit;

a cutting device for cutting the printing material in order to remove the printing material from the printing device, the cutting device being arranged before the printing unit as viewed in a transport direction of the printing material;

said cutting device comprising a cutter arranged on a longitudinally extending push rod which moves the cutter during cutting in a direction of said longitudinal extent of the push rod for cutting the printing material, and for rotating the cutter into a hinged down parking position by rotating the push rod when not cutting the printing material.

6. The printing device, comprising:

a printing unit for printing a web-shaped material;

a feeder for feeding the printing material to the printing unit;

a cutting device for cutting the printing material in order to remove the printing material from the printing device, the cutting device being arranged before the printing unit as viewed in a transfer direction of the printing materials; and the cutting device comprises a reel cutter arranged on a push rod, the push rod being slidably mounted to a guide tube arranged parallel and adjacent to the printing material, the guide tube having in a longitudinal direction a guide groove receiving the push rod and which ends at one end at a transverse groove such that the reel cutter is hinged down in a parking position, and for cutting the printing material, the reel cutter is moveable in a rotary motion to the guide groove and in the guide groove along the printing material, cutting reels of the reel cutter grasping the printing material.

7. The printing device according to claim 5 wherein the printing device comprises an electrographic printing unit.

8. The printing device according to claim 5 wherein the printing device comprises an ink printing unit.

9. A continuous form printer, comprising:

a printing unit for printing a continuous web-shaped printing material;

a cutting device integrated with a continuous form printer for cutting the web-shaped printing material in case of a malfunction in order to facilitate paper removal;

said cutting device being positioned upstream from said printing unit; and said cutting device comprising a cutter arranged on a longitudinally extending push rod which moves the cutter during cutting in a direction of said longitudinal extent of the push rod for cutting the printing material, and for rotating the cutter into a hinged down parking position by rotating the push rod when not cutting the printing material.

10. The continuous form printer of claim 9 wherein the cutting device comprises a reel cutter arranged on said push rod, the push rod being slidably mounted to a guide tube arranged parallel and adjacent to the printing material;

the reel cutter being movable in a rotary motion from a parking position into a working position; and the reel cutter having cutting reels which grasp the printing material when the reel cutter is in the working position.

11. A printing device, comprising:

a printing unit for printing a web-shaped printing material;

a feeder for feeding the printing material to the printing unit;

a cutting device between the printing unit and the feeder for cutting the printing material in order to remove the printing material from the printing device in the event of a malfunction;

the cutting device comprising a reel cutter which moves transversely across the web-shaped printing material, the reel cutter being mounted to a guide unit; and a longitudinally extending push rod connected to the reel cutter for causing said transverse movement by pushing the push rod in a direction of its longitudinal extent, and the push rod turning the reel cutter into a downward parking position by rotating the push rod when not cutting.

12. A method for removing a web-shaped printing material from a printing device when a malfunction occurs, said printing device having a printing unit, comprising the steps of;

positioning a cutting unit upstream of the printing unit;

when the malfunction occurs, activating the cutting unit to cut the printing material transversely to its running direction and then pulling a downstream portion of the printing material in a downstream direction away from the printing unit and also pulling an upstream portion of the material away from the printing unit in an upstream direction; and with a longitudinally extending push rod, pushing a cutter of the cutting unit in a direction of said longitudinal extent during cutting transversely to said running direction to cut the printing material, and when finished cutting the printing material, rotating the push rod to place the cutter in a downward parked position.

13. The method according to claim 12 including the step of positioning the cutting device between the printing unit and a feed unit for feeding the printing material toward the printing unit.

14. The method according to claim 12 including the step of providing the cutting device as a reel cutter and moving the reel cutter transversely to a flow direction of the printing material.

15. The method according to claim 14 including the step of providing the reel cutter as cutting reels facing each other.

16. The method according to claim 12 including the step of providing the cutting device on a guide rail such that a reel cutter of the cutting device having opposing cutting reels is positioned such that a nip between the cutting reels can engage an edge of the web-shaped printing material in a working position.

* * * * *